US008371340B2

(12) United States Patent
Fubuki et al.

(10) Patent No.: US 8,371,340 B2
(45) Date of Patent: Feb. 12, 2013

(54) EDGEWISE WINDING METHOD AND EDGEWISE WINDING APPARATUS

(75) Inventors: Shingo Fubuki, Toyota (JP); Kenji Harada, Miyoshi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 385 days.

(21) Appl. No.: 12/680,842

(22) PCT Filed: Dec. 10, 2008

(86) PCT No.: PCT/JP2008/072904

§ 371 (c)(1),
(2), (4) Date: Mar. 30, 2010

(87) PCT Pub. No.: WO2009/081802

PCT Pub. Date: Jul. 2, 2009

(65) Prior Publication Data

US 2010/0212771 A1 Aug. 26, 2010

(30) Foreign Application Priority Data

Dec. 26, 2007 (JP) ..... 2007-334821

(51) Int. Cl.
*B21F 3/00* (2006.01)
*B21F 3/02* (2006.01)

(52) U.S. Cl. ..... 140/102; 140/92.2; 72/135

(58) Field of Classification Search ..... 140/102, 140/92.2; 72/217–218, 306–307, 371, 135; 29/596–597, 605, 33 F
See application file for complete search history.

(56) References Cited

U.S. PATENT DOCUMENTS

| | | | | |
|---|---|---|---|---|
| 2,531,534 | A | 11/1950 | Sheley | |
| 4,077,244 | A * | 3/1978 | Umehara et al. | 72/129 |
| 2003/0131467 | A1* | 7/2003 | Kogler et al. | 29/605 |
| 2007/0079642 | A1* | 4/2007 | Bibeau et al. | 72/307 |
| 2010/0000624 | A1* | 1/2010 | Matsushita et al. | 140/124 |
| 2010/0180977 | A1* | 7/2010 | Sugishima | 140/71 C |

FOREIGN PATENT DOCUMENTS

| | | | |
|---|---|---|---|
| JP | 2002-184639 | A | 6/2002 |
| JP | 2003-181579 | A | 7/2003 |
| JP | 2005-093852 | A | 4/2005 |
| JP | 2005-324211 | * | 11/2005 |
| JP | 2006-288025 | A | 10/2006 |
| JP | 2008-126261 | A | 6/2008 |
| JP | 2008-212957 | A | 9/2008 |

* cited by examiner

*Primary Examiner* — Dana Ross
*Assistant Examiner* — Mohammad I Yusuf
(74) *Attorney, Agent, or Firm* — Kenyon & Kenyon LLP

(57) ABSTRACT

An edgewise winding method for forming an edgewise winding having a non-circular outer shape including a bent portion, a short side portion, and a long side portion is achieved by feeding a wire by a length corresponding to the short side portion or the long side portion and edgewise bending the wire by a bending jig while rotating an entire winding to form the bent portion. A side surface of the long side portion of the winding is supported by a first support block, a second support block, a first stopper block, a second stopper block, and others.

8 Claims, 13 Drawing Sheets

EDGEWISE WINDING METHOD AND EDGEWISE WINDING APPARATUS

This is a 371 national phase application of PCT/JP2008/072904 filed 10 Dec. 2008, claiming priority to Japanese Patent Application No. 2007-334821 filed 26 Dec. 2007, the contents of which are incorporated herein by reference.

TECHNICAL FIELD

The present invention relates to a technique for efficiently winding a coil by use of an edgewise winding apparatus.

BACKGROUND ART

As a coil to be used in a rotary electric machine, there is a wound coil made of a flat wire having a rectangular cross section besides a wound coil made of a wire having a circular cross section. To increase an amount of electric current allowed to flow in the coil, the coil must be formed of a thick wire. Such increase in cross sectional area of the wire tends to deteriorate a space factor of the wound coil made of the circular cross-section wire. On the other hand, the wound coil made of the rectangular cross-section wire is less likely to deteriorate a space factor even when the wire has a larger cross sectional area.

The coil for use in the rotary electric machine to be mounted in a vehicle is heretofore required to be compact and have high performance. In particular, the rotary electric machine used in a vehicle driving section has to be supplied with a large amount of current, whereas the rotary electric machine has a severe limitation in size because it needs to be installed in an engine room. Accordingly, the coil made of the flat wire having a rectangular cross section capable of enhancing the space factor is preferably used in a vehicle-mounted drive motor.

However, such rotary electric machine needs a coil of a non-circular outer shape, more preferably, of an outer shape as near as possible to a rectangular shape in order to shorten the length of a coil end. Such non-circular coil is likely to cause various problems in a manufacturing process due to a difference in winding speed between a long side portion and a short side portion. If winding is done at an extreme low speed, even a non-circular coil could be wound easily. However, for enhancing productivity, the non-circular coil must be wound at high speed.

JP2002-184639A discloses a technique for producing a coil from such a flat wire. This technique winds the flat wire on an elliptic cylindrical winding core by rotating the core. The flat wire is thus wound on the winding core to follow the shape of the winding core. Furthermore, the flat wire is pressed by a retaining member against a fixing member that rotates together with the winding core to restrain expansion of the flat wire and vibration or wobble of the wire during winding.

This retaining member is slidable in a thickness direction of a coil to be produced. As the winding of the flat wire is advanced, the retaining member will move apart from the fixing member. A brake means is provided at a predetermined position perpendicular to the winding core to cause resistance in movement of the flat wire. This brake means is movable together with the retaining member in an axis direction of, the winding core.

The flat wire is wound as pressed by the retaining member in such a way. Accordingly, during winding of the flat wire on the elliptic cylindrical winding core, it is possible to prevent inertia vibration or wobble of the flat wire due to a difference in winding speed in a long side portion and a short side portion, and hence achieve high speed coil winding.

JP2006-288025A discloses a technique related to a rectangular coil, a rectangular coil manufacturing method, and a rectangular coil manufacturing apparatus. A bending device for edgewise bending a rectangular flat wire includes holding means for clamping a linear flat wire, the holding means having a groove equal in width to the flat wire, roller-shaped restriction means which will come into contact with an inner periphery of the flat wire during edgewise bending, and pressing means which will come into contact with an outer periphery of the flat wire during the edgewise bending and rotate to edgewise bend the flat wire.

The flat wire is passed through the bending device and the pressing means is rotated to edgewise bend a predetermined portion of the flat wire. Then, the flat wire is fed until another portion for the next edgewise bending comes to a predetermined place and the same operation is repeated. By repetition of such operation, a coil made of the flat wire by edgewise bending is thus produced.

SUMMARY OF INVENTION

Technical Problem

The techniques disclosed in JP2002-184639A and JP2006-288025A to produce a coil from the flat wire may cause the following disadvantages.

In the case of producing a coil by the method disclosed in JP2002-184639A, the inner periphery of the coil is shaped conforming to the shape of the winding core. For insertion of the coil in a stator or the like, however, there is a demand for enhancing a space factor as high as possible. Therefore, it is preferable to produce a coil having a trapezoidal outer shape instead of the elliptic cylindrical shape. However, if the winding core is of a cone shape, the retaining member is not allowed to move. The method of JP2002-184639A could not directly be applied to winding of the trapezoidal coil.

When the length difference in a long side portion and a short side portion of the coil is larger, the inertia vibration of the flat wire inevitably becomes so large that the method of JP2002-184639A may not sufficiently absorb the inertial vibration. However, the larger number of coils is more advantageous in enhancing power of the rotary electric machine and achieving smooth operation thereof. For this end, the coil has to be designed with a large length difference between the long side portion and the short side portion.

On the other hand, the method of JP2006-288025A also can produce a coil having a large length difference between the long side portion and the short side portion. However, the coil is in a free state and thus likely to be influenced by inertia as winding of the coil is advanced. When a wire is wound at quite high speed, a wound portion is swung around, resulting in undesirable loss of shape, or deformation, of the coil.

To provide the rotary electric machine at low cost, it is essential to reduce the cost of a plurality of coils used in one rotary electric machine. For cost reduction, the coils have to be produced at high speed. However, the method of JP2005-288025A needs the operation of rotating and returning the pressing means. This operation will disturb high speed winding.

In other words, it appears that the technique of JP2002-184639A could not easily produce the coil having a large length difference between the long side portion and the short side portion and the technique of JP2006-288025A could not easily wind the coil at high speed.

A recent motor mounted in a hybrid electric vehicle or the like is required to output high power and also to be compact in size. Furthermore, price competitiveness of a product is also demanded. It is desired to realize high speed winding of a coil having a large difference in length between a long side portion and a short side portion.

To solve the above problems, the present invention has an object to provide an edgewise winding method and an edgewise winding apparatus arranged to wind a coil including a bent portion and an unbent portion at high speed.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

Solution to Problem (1) To achieve the above object, the invention provides an edgewise winding method for forming an edgewise winding having a non-circular outer shape including a bent portion and an unbent portion, the method comprising: feeding a wire by a distance corresponding to the unbent portion; and edgewise bending the wire by a bending jig while rotating the entire winding to form the bent portion; wherein a side surface of the unbent portion of the winding is supported by a side support member.

Herein, the winding includes a finished coil having a non-circular outer shape made by edgewise bending and an unfinished coil in process of winding.

In the case of high-speed winding, the non-circular edgewise winding may cause loss of shape when the winding is swung around as mentioned as the problem to be solved. Specifically, the winding has to be rotated simultaneously at the start of edgewise bending a wire. However, if the winding is not supported, a force deriving from inertia causes the winding to stay there as a winding speed increases. After completion of the edgewise bending, on the other hand, a force acts on the winding to move it continuously.

The higher the winding speed, the larger the inertia force becomes. When the inertia force is larger than stiffness of the wire, the winding tends to lose its shape in process of a winding operation. To avoid such defect, a side surface of the unbent portion of the winding is supported by the side support member in order to prevent the winding from deformation even when the above inertia force acts on the winding. Consequently, high-speed winding of the winding can be realized.

(2) In the edgewise winding method (1), preferably, the side support member is located in a rotation rear side or a rotation front side of the unbent portion of the winding and will be rotated in sync with the winding.

As mentioned above, since the inertia force acts at the start of edgewise bending of the wire, the side support member is placed in the rotation rear side of the winding. Since the inertia force acts at the end of edgewise bending of the wire, the side support member is placed in the rotation front side of the winding. Accordingly, the winding can be supported.

Herein, the "rotation front side" represents a front side of the winding in a rotation direction and the "rotation rear side" represents a rear side of the winding in the rotation direction. The winding and the side support member are rotated at the same time to set a longer time for supporting the side surface of the unbent portion of the winding by the side support member. This makes it possible to more reliably prevent vibration or wobble of the winding 15 and further prevent deformation thereof. Thus, high speed winding of the winding is made practicable.

(3) In the edgewise winding method (2), preferably, the side support member is inserted as a common stopper inside the winding to support both the rotation front side and the rotation rear side of the winding from an inner periphery side of the winding and will be rotated in sync with the winding.

The aforementioned side support member may be placed inside the winding instead of the outside of the winding. When the side support member is placed inside the winding and rotated in sync with the winding, the winding can be prevented from becoming deformed during edgewise bending of the wire. Accordingly, high speed winding of the winding is made practicable.

(4) In the edgewise winding method (1), preferably, the side support member is movable to advance to a front of a rotation stop position of the unbent portion of the winding and retract to an outside of a rotation range of the winding.

Herein, the "front of the rotation stop position" represents the front side of the stop position of the winding in the rotation direction at the end of the edgewise bending at which the winding is stopped simultaneously. During edgewise bending of the wire to form the winding, there is a case where the side support member is placed within a rotation range of the winding. In this case, the side support member if unnecessary may disturb the winding. Thus, the side support member is configured to advance and retract, so that the winding can be wound without interfering with the side support member.

(5) In one of the edgewise winding methods (1) to (4), preferably, a retaining member is slid in a direction of thickness of the winding, the retaining member having a shape along a rotation path of the unbent portion located on an outer circumferential side of the winding during rotation.

Accordingly, in cooperation with the side support member, it is possible to restrain vibration or wobble of the winding caused in the high speed edgewise bending of the wire.

(6) To achieve the above object, according to another aspect, the present invention provides an edgewise winding apparatus for forming an edgewise winding having a non-circular outer shape including a bent portion and an unbent portion, the apparatus comprising: a wire feed system for feeding a wire by a predetermined distance; and a bending jig for edgewise bending the wire while the entire winding is rotated, wherein the apparatus further comprises a side support member for supporting a side surface of the unbent portion of the winding.

Accordingly, as with the edgewise winding method (1), the presence of the side support member allows high-speed winding without deforming the winding. Thus, an edgewise winding apparatus capable of performing high-speed winding of the winding can be provided.

(7) The edgewise winding apparatus (6), preferably, further comprises: a synchronization mechanism for rotating the side support member located in a rotation rear or front side of the unbent portion of the winding in sync with the winding.

Accordingly, as with the edgewise winding method (2), it is possible to wind the winding at high speed without shape loss by rotating the side support member in sync with the winding. The synchronization mechanism for allowing the motion of this side support member has only to be configured to rotate the side support member in sync with the bending jig. For instance, it is conceivable to use a turn table on which the side surface is mounted and which operates in sync with the motion of the winding.

In this way, the side support member is moved in sync with rotation of the winding by the synchronization mechanism, namely, in sync with the bending jig. Accordingly, an edgewise bending apparatus can be provided capable of performing high-speed winding while preventing shape loss of the winding caused by the inertia force.

(8) In the edgewise winding apparatus (7), preferably, the side support member is inserted as a common stopper inside the winding to support both the rotation front side and the rotation rear side of the winding from an inner periphery side of the winding, the side support member being rotated in sync with the winding by the synchronization mechanism.

Accordingly, as with the edgewise winding method (3), since the side support member is placed inside the winding and rotated in sync with the winding, so that the winding can be prevented from becoming deformed and hence can be wound at high speed.

(9) The edgewise winding apparatus (6), preferably, further comprises a forward/backward moving mechanism for advancing the side support member to a front of a rotation stop position of the unbent portion of the winding and retracting the side support member to an outside of a rotation range of the winding.

Accordingly, as with the edgewise winding method (4), the side support member can be retracted during winding in the case where the side support member is likely to disturb the wire winding. The forward/backward moving mechanism for advancing and retracting this side support member includes a drive mechanism connected to the side support member to retract the side support member out of the rotation range of the winding. For instance, a linear motion mechanism such as a cylinder may be adopted to move the side support member.

Such forward/backward moving mechanism of the side support member allows the side support member to support the side surface of the unbent portion of the winding without disturbing the rotation of the winding. Consequently, an edgewise winding apparatus can be provided capable of performing high-speed winding.

(10) One of the edgewise winding apparatuses (6) to (9), preferably, further comprises a retaining member slidable in a direction of thickness of the winding, the retaining member having a shape along a rotation path of the unbent portion located on an outer circumferential side of the winding during rotation.

Accordingly, as with the edgewise winding method (5), it is possible to restrain shape loss of the winding by the retaining member in combination with the side support member. Thus, an edgewise winding apparatus can be provided capable of performing high-speed winding of the winding.

BRIEF DESCRIPTION OF DRAWINGS

The accompanying drawings, which are incorporated in and constitute a part of this specification illustrate an embodiment of the invention and, together with the description, serve to explain the objects, advantages and principles of the invention.

In the drawings.

DESCRIPTION OF EMBODIMENTS

A detailed description of preferred embodiments of the present invention will now be given referring to the accompanying drawings.

<First Embodiment>

Figure 1:
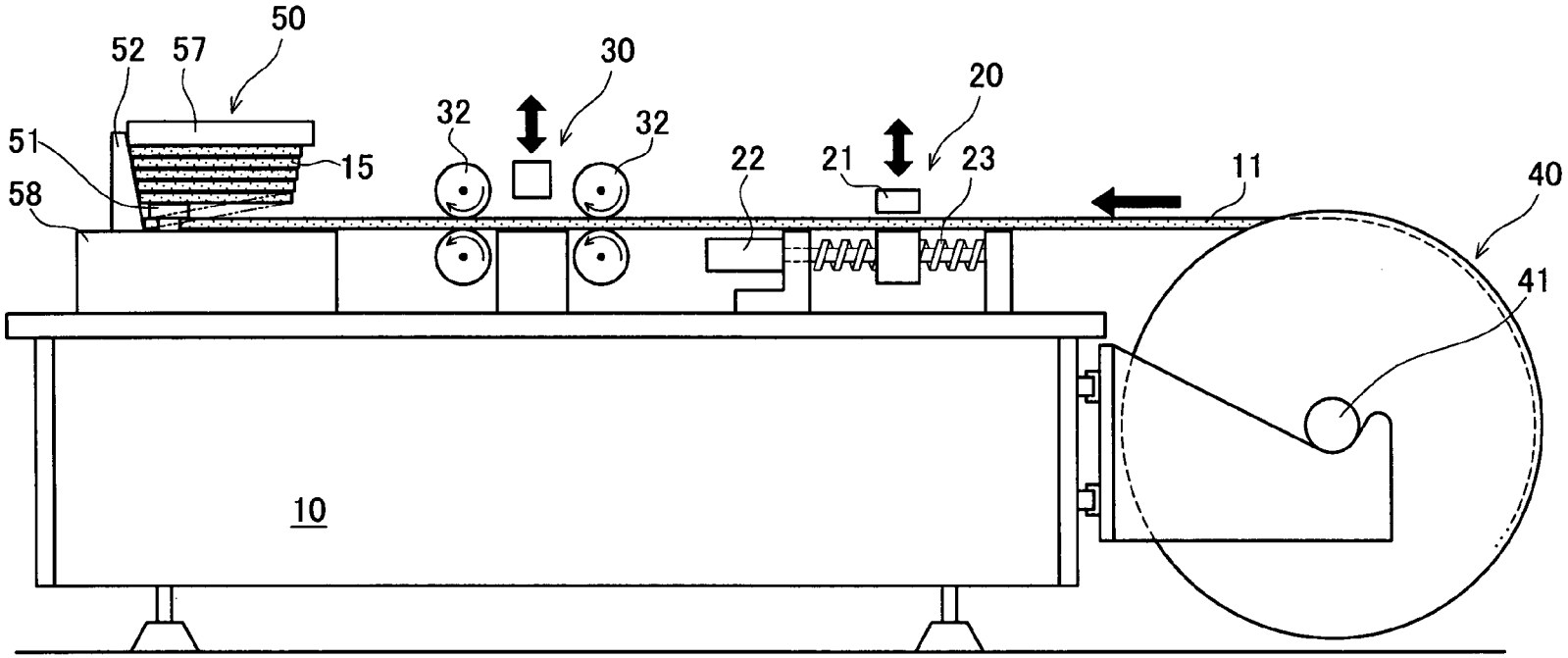
FIG. 1 is a schematic side view of an edgewise winding apparatus in a first embodiment.

FIG. 1 is a schematic side view of an edgewise winding apparatus 10 in the first embodiment. This apparatus 10 includes a feed system 20, a wire clamp part 30, a bending system 50, and an uncoiler 40. The apparatus 10 is arranged to form a winding 15 from a wire 11 unreeled from a bobbin 41 of the uncoiler 40. The feed system 20 is provided with a function of clamping the wire 11 with a movable clamper 21 and feeding it toward the bending system 50 by a predetermined distance to unreel a predetermined length of the wire 11 from the bobbin 41.

After the movable clamper 21 is moved by a predetermined distance, the clamper 21 is unclamped and returned to a home position. This operation is repeated to feed a predetermined length of the wire 11 at necessary timing. The feed system 20 comprises a servo motor 22 and a trapezoidal screw 23 in combination to feed the wire 11 precisely.

The wire clamp part 30 is a system for holding the wire 11 and includes a fixed clamper 31 to hold the wire 11. The wire clamp part 30 further includes guide rollers 32 each of which is configured to rotate only in a direction to feed the wire 11.

Figure 2:
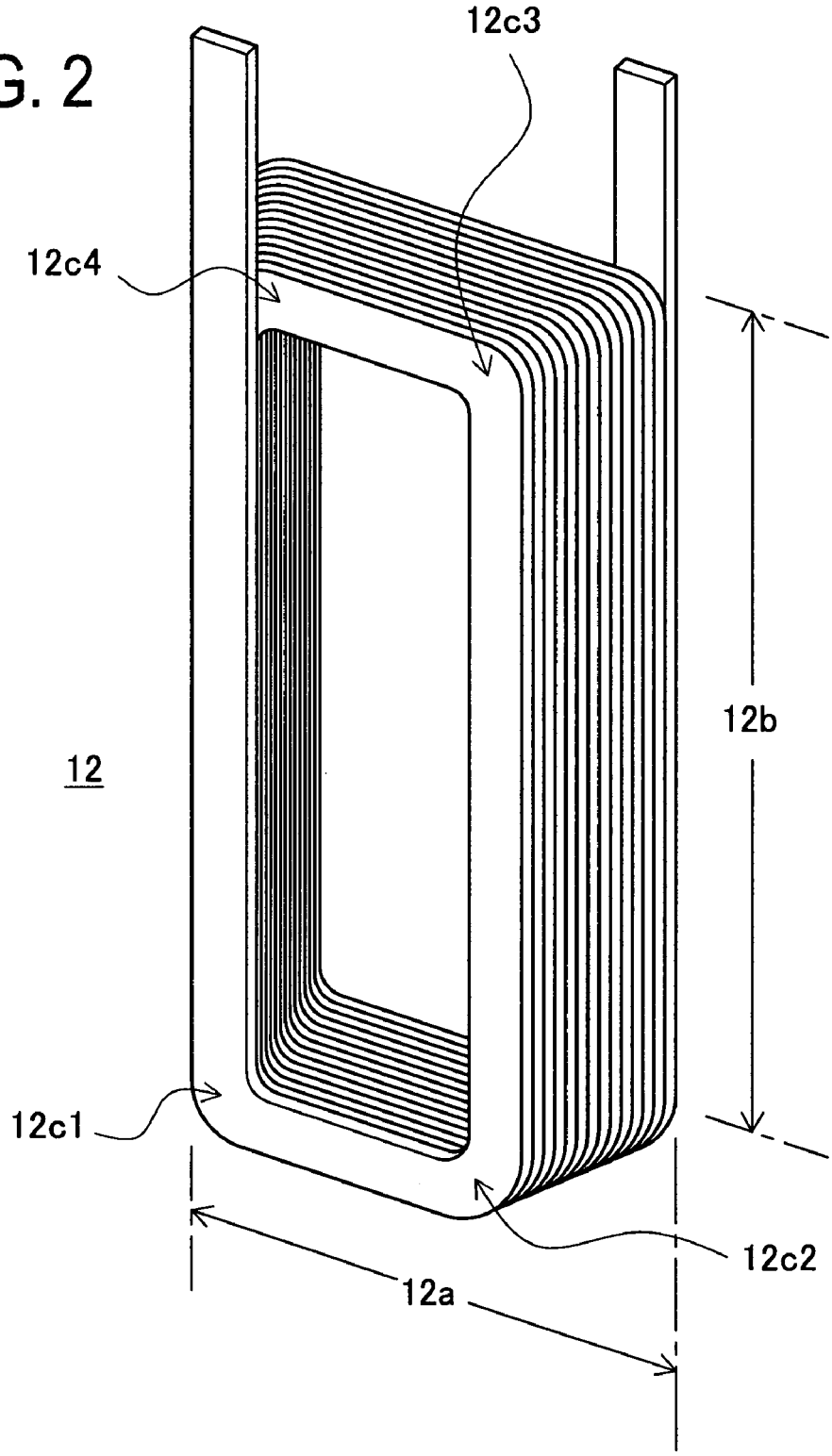
FIG. 2 is a perspective view of a coil made of a wire by winding in the first embodiment.

FIG. 2 is a perspective view of a coil 12 made of the wire 11 by winding. This coil 12 is a finished product of the winding 15 which is non-circular edgewise winding. The coil 12 has short side portions 12*a* and long side portions 12*b* as unbent portions, and bent portions 12*c*.

For convenience, the bent portions 12*c* are referred to as a first bent portion 12*c*1, a second bent portion 12*c*2, a third bent portion 12*c*3, and a fourth bent portion 12*c*4. In the case where the bent portion is referred to as the bent portion 12*c* simply, it represents one or all of the first to fourth bent portions 12*c*1 to 12*c*4. Furthermore, for convenience, an unfinished product formed in the process of winding the wire 11 is referred to as the winding 15 and a finished product capable of being mounted in a stator not shown after the edgewise bending is referred to as the coil 12.

In the coil 12, the short side portions 12*a* are laminated to have different lengths so that the short side portions 12*a* are longer on a back side than on a front side of the coil 12 in FIG. 2. This is because the coil 12 is formed with a trapezoidal cross section effective in being mounted in the stator not shown. The bending system 50 is arranged to edgewise bending the wire 11 to form the winding 15.

Figure 3:
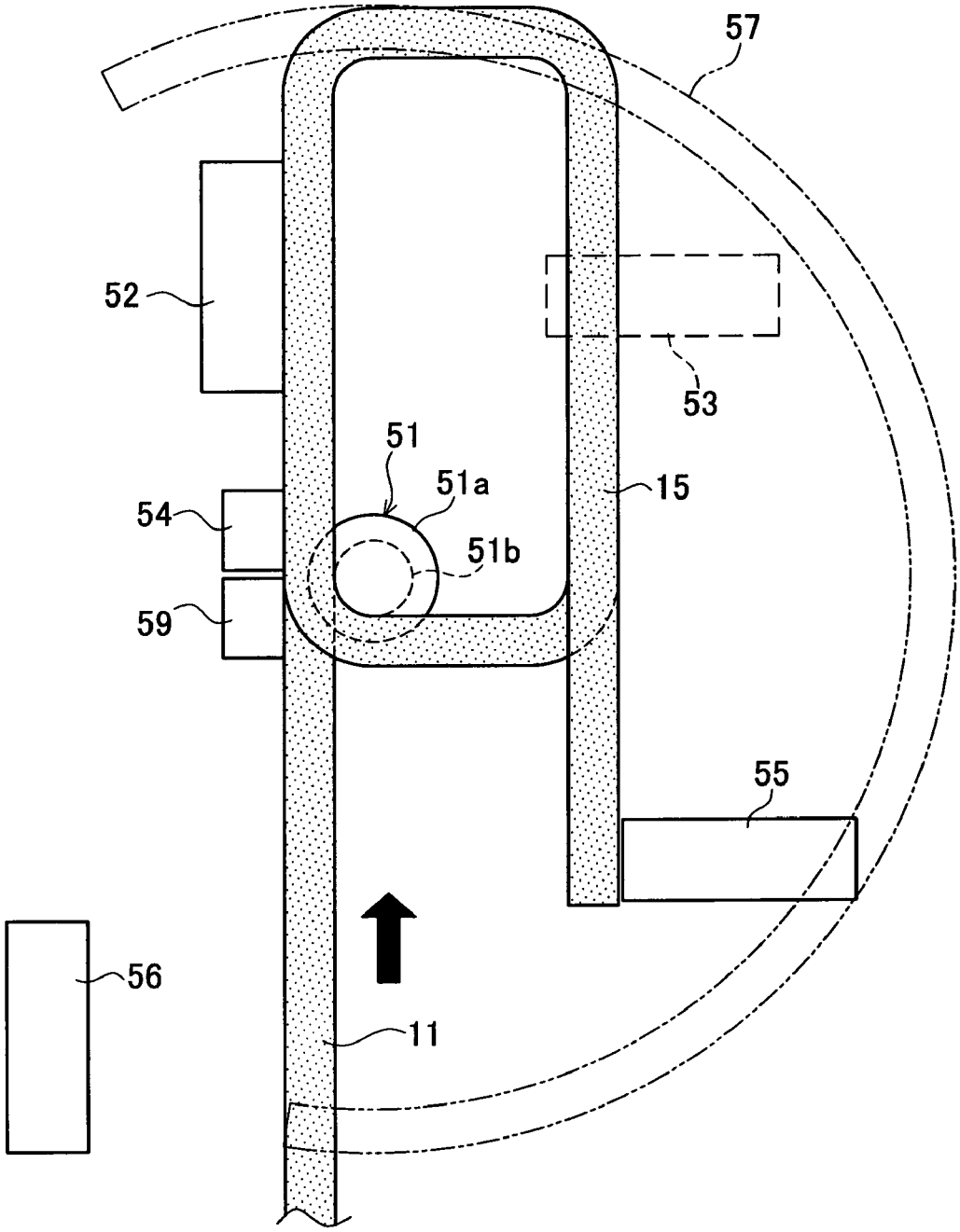
FIG. 3 is a schematic view of a first step of a bending system in the first embodiment.

FIG. 3 is a schematic plan view of the bending system 50. This bending system 50 includes a flange clamp 51, a long-side rotation support block (hereinafter, a first supporting block) 52, a short-side rotation support block (hereinafter, a second support block) 53, a bending jig 54, a stopper block 55 for long-side bending (hereinafter, a first stopper block), a stopper block 56 for short-side bending (hereinafter, a second stopper block), and an upper guide 57.

The flange clamp 51 is provided protruding from a rotary table 58 and includes a flange 51*a* and a rod 51*b*. By vertical movement of the flange clamp 51 relative to the rotary table 58, the flange 51*a* clamps a portion of the wire 11 corresponding to an inner circumferential side of the bent portion 12*c* of the winding 15 against the rotary table 58.

In order to prevent the wire 11 from expanding during the edgewise bending, the distance between the lower surface of the flange 51*a* and the upper surface of the rotary table 58 can be maintained to be equal to the thickness of the wire 11. The rod 51*b* is connected to a power source and is rotated together with the rotary table 58.

The first support block 52 is a side support member for supporting a rotation rear side of the winding 15 (a side surface of the winding 15 located on a rear side in a rotation direction of the winding 15 to be turned), namely, an unbent portion. This block 52 is rotated in sync with the rotary table 58. The block 52 is located in a portion to support the side surface of the winding 15. The surface of the block 52 to support the side surface of the winding 15 is slant at an angle of several degrees with respect to the rotary table 58. This slant surface of the block 52 supports the outer surface of a side portion which will become the long side portion 12*b* of the coil 12 when the winding 15 is formed into the coil 12.

The second support block 53 is a side support member for supporting the side surface of the winding 15 located on the rotation rear side in the same manner as the first support block 52 and will be rotated in sync with the rotary table 58. The surface of the block 53 for supporting the side surface of the winding 15 is slant at an angle of several degrees with respect to the rotary table 58. The block 53 is configured to retract into the rotary table 58.

The bending jig 54 has a thickness almost equal to the thickness of the wire 11 and is placed on the rotary table 58. When the bending jig 54 is rotated in sync with the rotary table 58, the bending jig 54 applies a force on the side surface of the wire 11 to edgewise bend the wire 11.

In sync with rotation of the rotary table 58, the bending jig 54 is rotated in contact with the side surface of the wire 11, thereby applying a force in a direction of width of the wire 11. As a result, the wire 11 is edgewise bent.

A guide 59 is fixed independently of the rotary table 58 to guide the wire 11. When the wire 11 is fed by the wire clamp part 30, therefore, the wire 11 can be guided by the rod 51*b* of the flange clamp 51 and the guide 59 so as not to vibrate or wobble.

The first stopper block 55 is a side support member for supporting a side surface of the winding 15. The surface of the block 55 supporting the winding 15 is applied with a cushioning such as urethane rubber to absorb shock when the winding 15 bumps against the first stopper block 55. The first stopper block 55 is placed in front of a rotation stop position of the winding 15 to support the side surface of the winding 15 which will become the long side portion 12*b* as an unbent portion.

The first stopper block 55 is supported independently of the rotary table 58 and includes a forward/backward moving mechanism for retracting the block 55 to the outside of a rotation range of the winding 15 in order not to interfere with the motion path of the winding 15. For example, this moving mechanism may be achieved by a linear motion mechanism such as an air cylinder. A retract position of the block 55 may be above the upper guide 57.

The second stopper block 56 is a side support member for supporting the side surface of the winding 15. As with the first stopper block 55, the surface of the second stopper block 56 supporting the winding 15 is applied with a cushioning such as urethane rubber to absorb shock when the winding 15 bumps against the second stopper block 56. The second stopper block 56 is placed in front of the rotation stop position of the winding 15 to support the side surface of the winding 15 which will become the long side portion 12*b* as an unbent portion.

The second stopper block 56 is supported independently of the rotary table 58 and includes a forward/backward moving mechanism for retracting the block 56 to the outside of the rotation range of the winding 15 in order not to interfere with the motion path of the winding 15. For example, this moving mechanism may be achieved by a linear motion mechanism such as an air cylinder. A retract position of the block 56 may be above the upper guide 57. Furthermore, the second stopper block 56 also serves as a guide for feeding the wire 11. Of the second stopper block 56, a portion (a sliding surface) 56*a* located near the rotary table 58 to guide the wire 11 is not applied with the cushioning. Similarly, a portion (a sliding surface) 55*a* of the first stopper block 55 located near the rotary table 58 is not applied with the cushioning.

The upper guide 57 is placed as a retaining member for retaining the upper side of the winding 15. The upper guide 57 has a shape along a rotation path of a short side portion of the winding 15, the short side portion being located on an outer circumferential side of the winding 15 during rotation around the flange clamp 51 to edgewise bend the wire 11 clamped by the flange clamp 51. In FIG. 3, the upper guide 57 is illustrated as a shape like a horseshoe. The upper guide 57 is placed in direct correct with the winding 15 in the present embodiment. Alternatively, the upper guide 57 is not intended to hold the winding 15 down and thus it may be spaced with fixed clearance from the wire 15.

The upper guide 57 is configured to move upward as the number of turns of the winding 15 increases and is located in such a position as to constantly contact with the upper surface of the winding 15. The upward movement of the upper guide 57 may be carried out by a configuration including a specific linear guide and a motor.

The surface of the upper guide 57 that contacts with the winding 15 is required to have a resistance to sliding. Accordingly, the contact surface of the upper guide 57 with respect to the winding 15 is preferably subjected to for example buffing with a stainless steel material or coating with a titanium type material.

The rotary table 58 is provided with the first support block 52, the second support block 53, and the bending jig 54. The rotary table 58 is rotatable at a fixed angle by a rotation mechanism. This rotation mechanism may be configured by for example a combination of a servo motor and a gear box. Alternatively, it may be configured by a combination of a harmonic drive and others to fine adjust a rotation angle.

Accordingly, the rotary table 58 serves as a synchronization mechanism of the first support block 52 and the second support block 53. The second support block 53 is arranged to be stored in the rotary table 58, i.e., retracted from the upper surface of the rotary table 58 into the rotary table 58, and reversely to protrude from the upper surface of the rotary table 58 by a lifting mechanism. This lifting mechanism may be constituted by a cam, for example.

Figure 4:
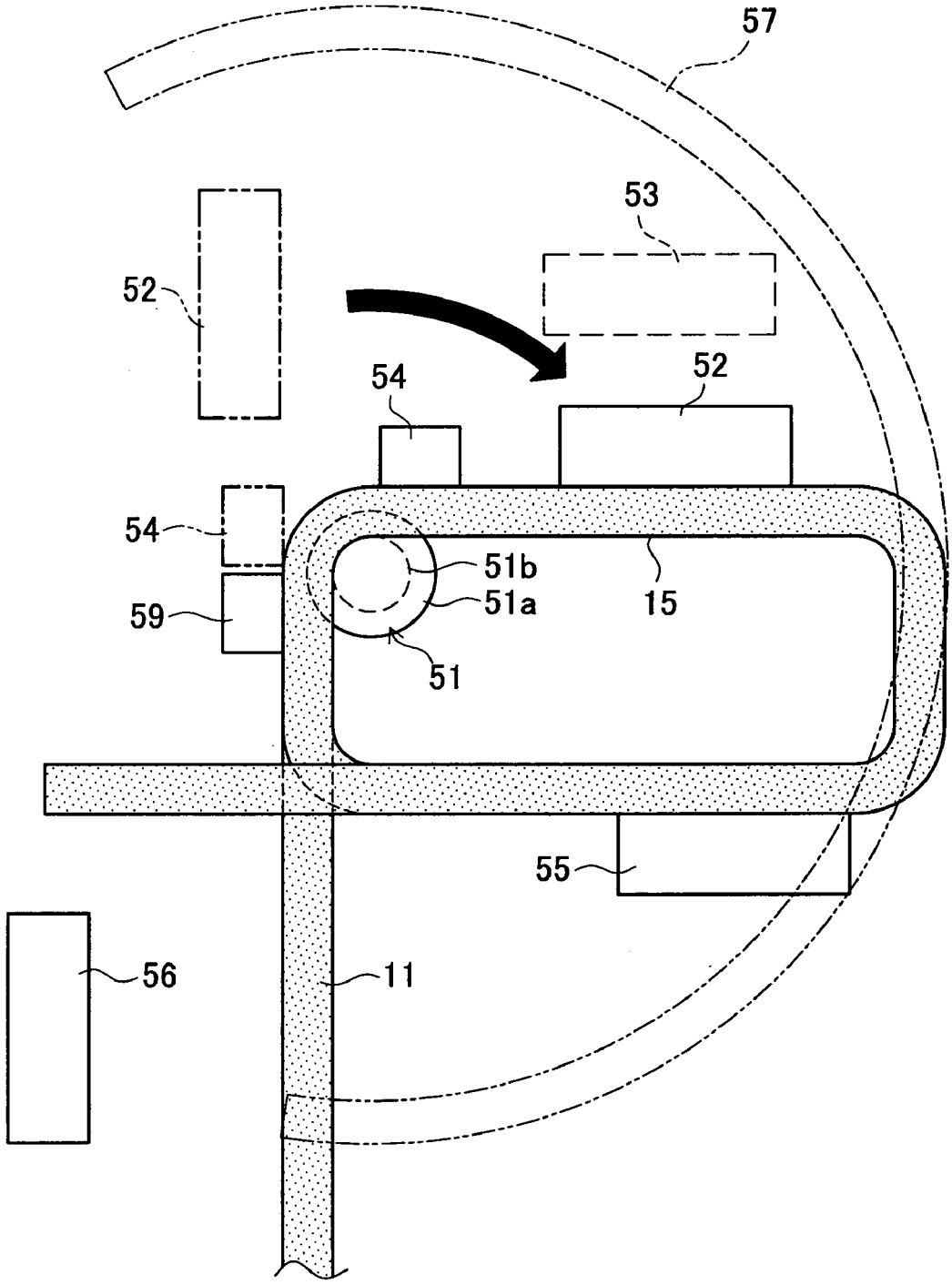
FIG. 4 is a schematic view of a second step of the bending system in the first embodiment.
Figure 5:
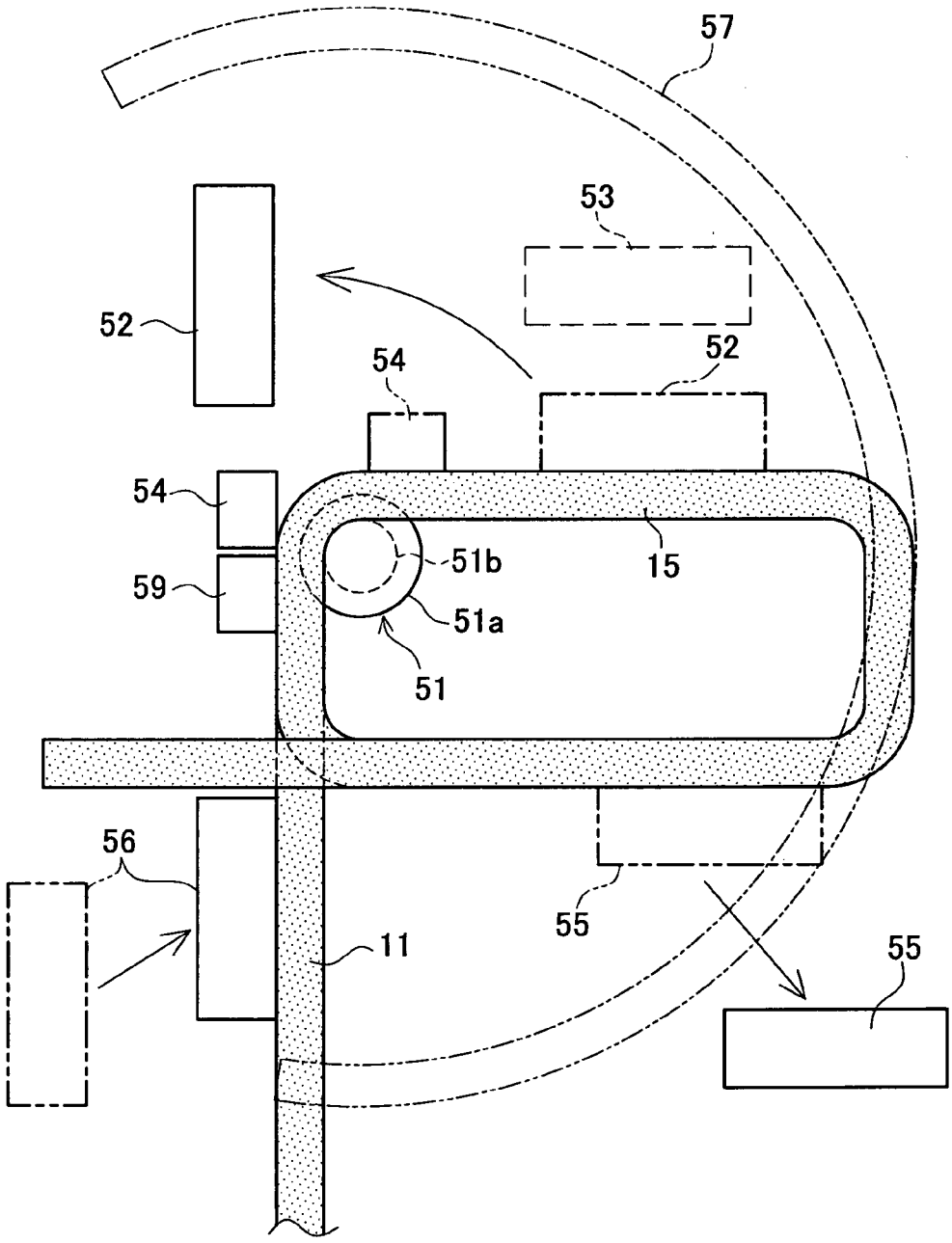
FIG. 5 is a schematic view of a third step of the bending system in the first embodiment.
Figure 6:
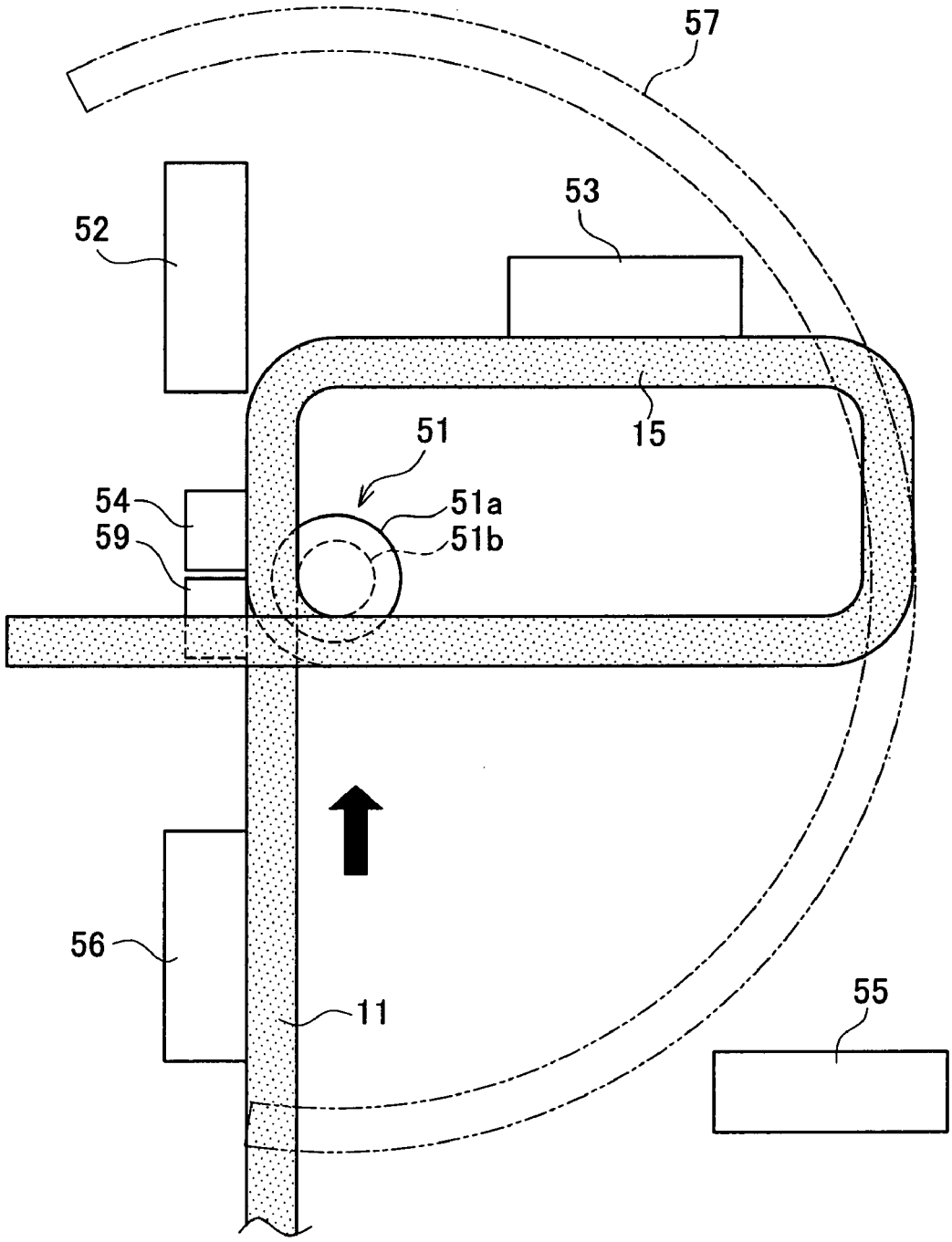
FIG. 6 is a schematic view of a fourth step of the bending system in the first embodiment.
Figure 7:
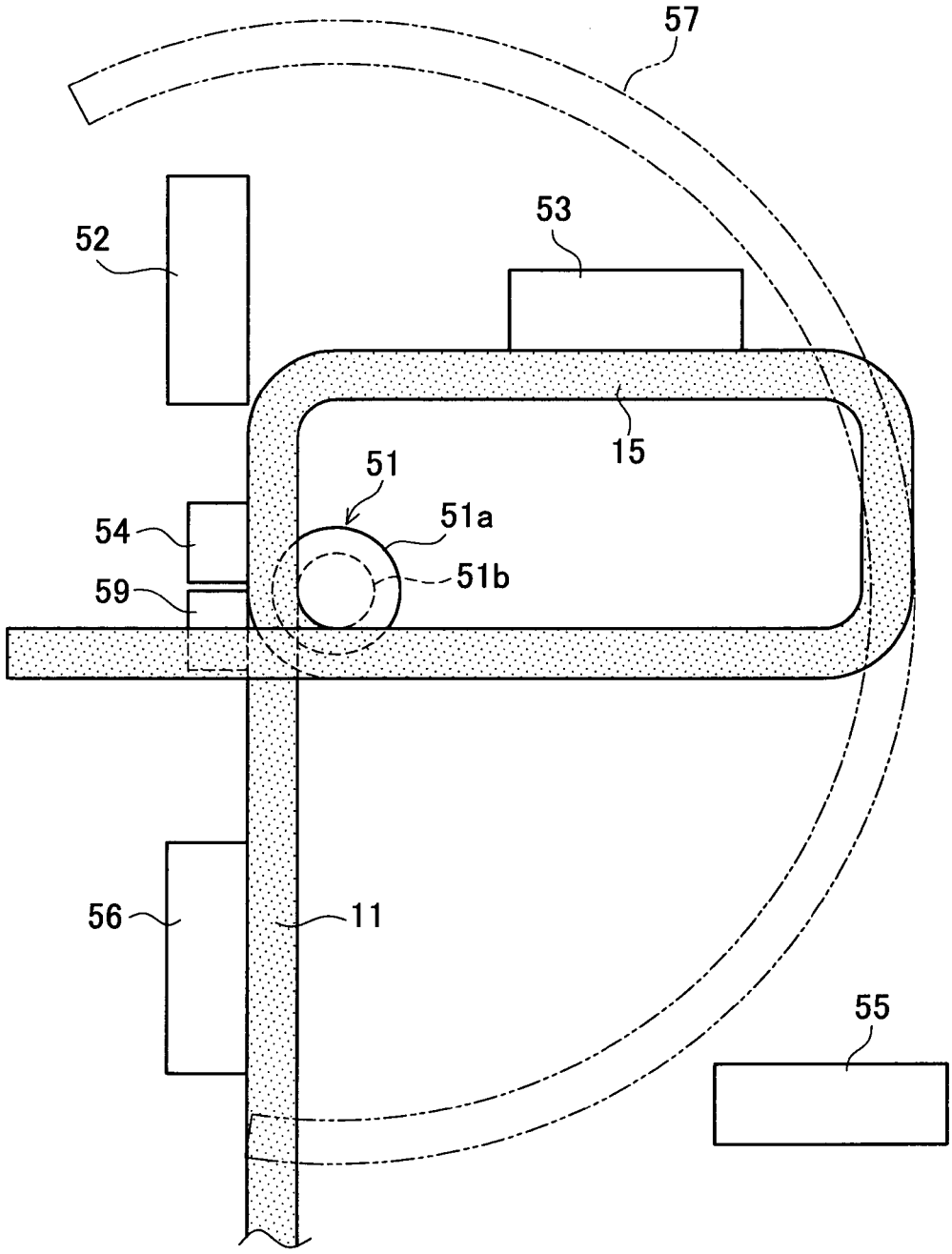
FIG. 7 is a schematic view of a fifth step of the bending system in the first embodiment.
Figure 8:
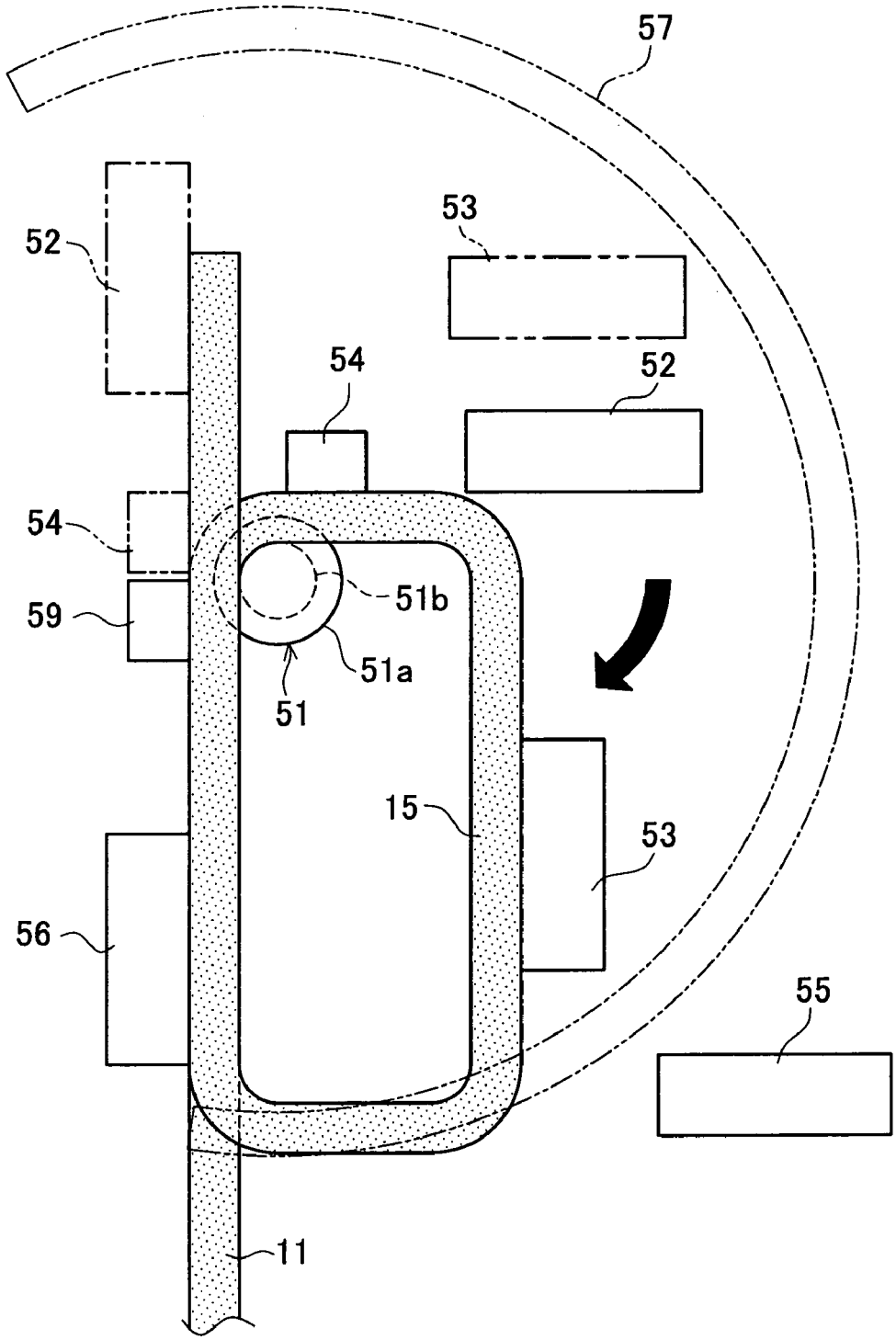
FIG. 8 is a schematic view of a sixth step of the bending system in the first embodiment.
Figure 9:
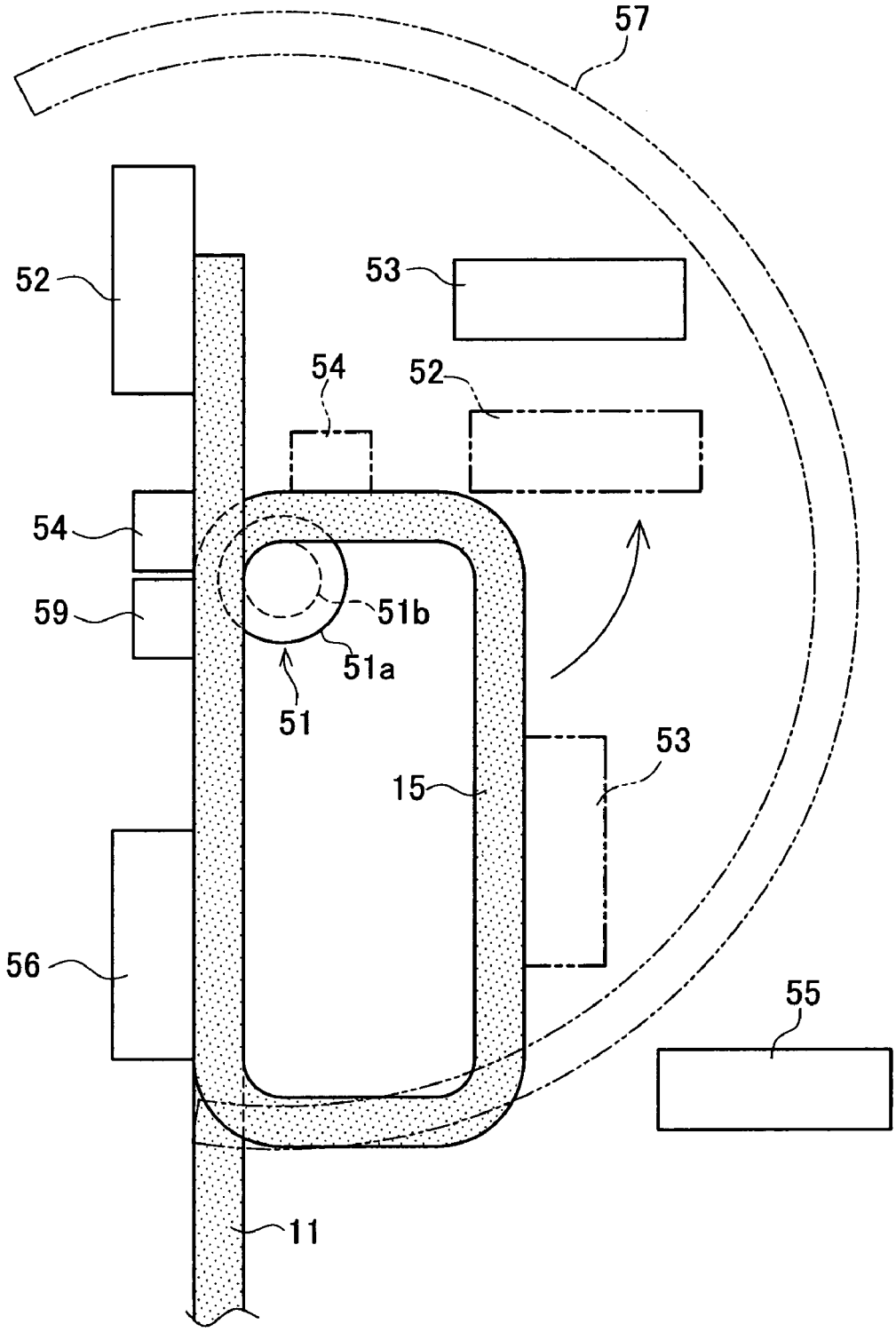
FIG. 9 is a schematic view of a seventh step of the bending system in the first embodiment.
Figure 10:
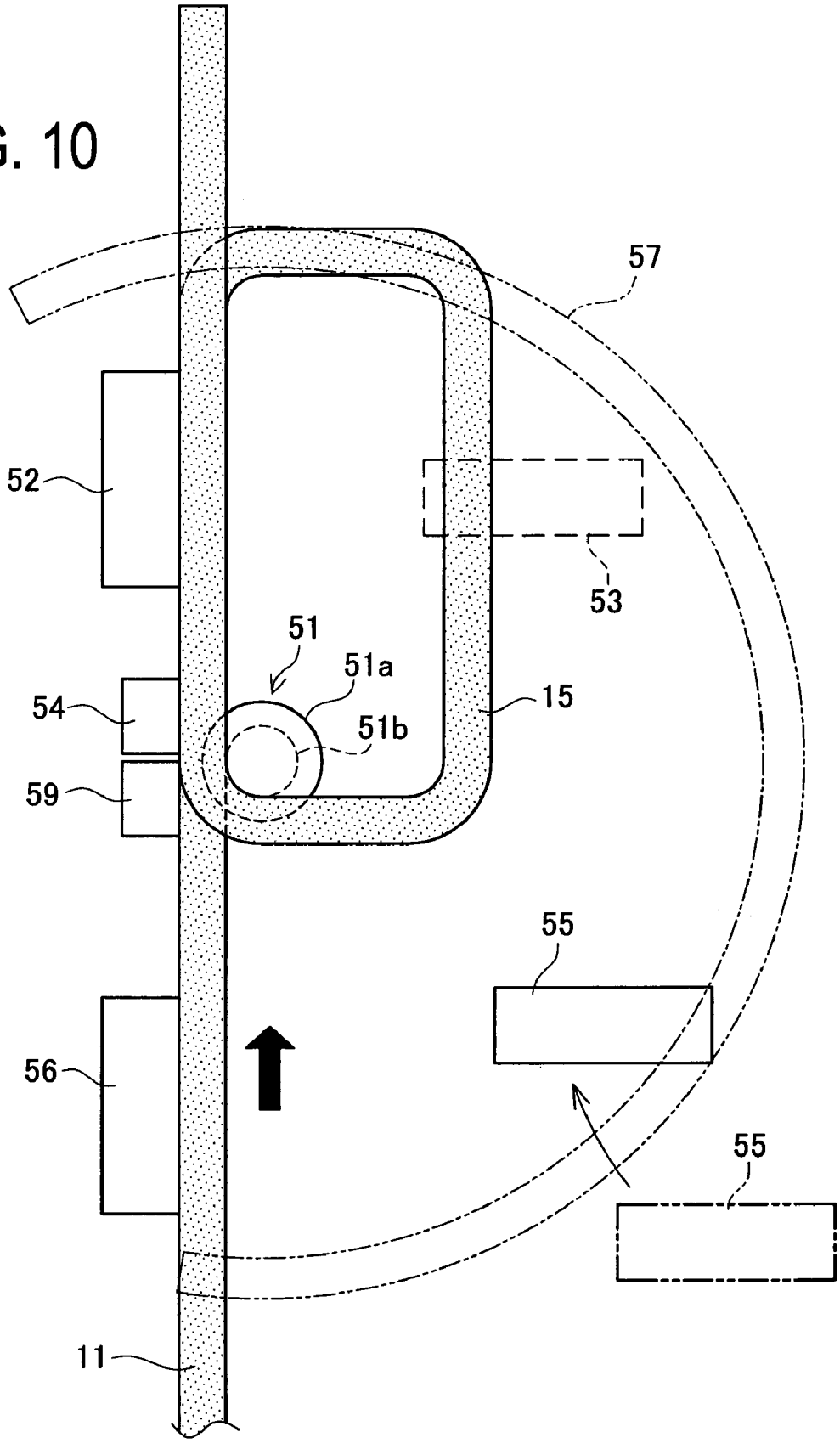
FIG. 10 is a schematic view of an eighth step of the bending system in the first embodiment.

An explanation will be given below to the operations of the bending system 50 in the first embodiment, referring to FIGS. 3 to 10. Specifically, FIG. 3 is a schematic view of a first step of the bending system 50; FIG. 4 is a schematic view of a second step; FIG. 5 is a schematic view of a third step; FIG. 6 is a schematic view of a fourth step; FIG. 7 is a schematic view of a fifth step; FIG. 8 is a schematic view of a sixth step; FIG. 9 is a schematic view of a seventh step; and FIG. 10 is a schematic view of an eighth step.

In the first step, the wire 11 is clamped by the flange clamp 51 as shown in FIG. 3. Concretely, the wire 11 is fed by a predetermined distance by being guided by the first support block 52, the bending jig 54, and the flange clamp 51, and then the wire 11 is clamped by the flange clamp 51. More specifically, the wire 11 is clamped by the flange 51*a* of the flange clamp 51 against the rotary table 58. As mentioned above, the distance between the rotary table 58 and the flange 51*a* is determined to be almost equal to the width (thickness) of the wire 11. Thus, the wire 11 is actually held so as not to be crushed.

In the second step, the wire 11 is subjected to edgewise bending as shown in FIG. 2. This edgewise bending is carried out by rotating the bending jig 54 and thereby applying a force on the wire 11. By this edgewise bending, a portion which will become the third bent portion 12*c*3 of the finished coil 12 is formed.

Simultaneously, the first support block 52 is also rotated. This is to prevent shape loss or deformation of the already wound winding 15. At a stage where the winding 15 is bent (rotated) up to a predetermined position as shown in FIG. 4, the winding 15 is supported by the first stopper block 55. This first stopper block 55 prevents shape loss or deformation of the winding 15 in an advancing or rotating direction. At this timing, the upper guide 57 is moved up.

In the third step, the first support block 52 and the bending jig 54 are returned to respective home positions as shown in FIG. 5. After the edgewise bending of the wire 11, the first support block 52 and the bending jig 54 are returned to respective predetermined positions. At that time, the first stopper block 55 placed in the advancing direction of the winding 15 is also retracted. The flange clamp 51 is unclamped. The second stopper block 56 is moved to a position for guiding the wire 11.

In the fourth step, the wire 11 is fed by a length corresponding to a short side portion as shown in FIG. 6. The second support block 53 is protruded from the rotary table 58 to support the side surface of the winding 15. Simultaneously, the wire 11 is fed by the length corresponding to the short side portion by the feed system 20. This feeding distance is adjusted by the servo motor of the feed system 20 so as to become shorter as the number of turns of the winding 15 is increased. The short side portions 12*a* are laminated to be gradually shorter in the finished coil 12. Correspondingly, the feed system 20 can also be controlled to perform such feeding. FIG. 6 shows a state where the wire 11 has been fed by the length corresponding to the short side portion.

In the fifth step, the wire 11 is clamped by the flange clamp 51 as shown in FIG. 7. Specifically, the wire 11 having been fed by the length corresponding to the short side portion is clamped again by the flange clamp 51. In the sixth step, the wire 11 is subjected to edgewise bending as shown in FIG. 8. More specifically, the wire 11 is edgewise bent by the bending jig 54 while the winding 15 is supported by the second support block 53. Thus, a portion which will become the fourth bent portion 12*c*4 of the finished coil 12 is formed.

The first support block 52 is provided in the rotary table 58 and hence is rotated together with the rotary table 58. At the stage where the winding 15 is bent up to a predetermined position as shown in FIG. 8, the winding 15 is supported by the second stopper block 56. This second stopper block 56 prevents the winding 15 from losing its shape in the advancing direction. Thus, the short side portion of the winding 15 is formed.

In the seventh step, the second support block 53 is returned to a predetermined position as shown in FIG. 9. Specifically, the support block 53 is returned to the predetermined position by rotation of the rotary table 58 after the edgewise bending of the wire 11 and the support block 53 is stored (retracted) in the rotary table 58. At that time, the bending jig 54 and the first support block 52 are simultaneously returned to respective predetermined positions.

In the eighth step, long-side feed of the wire 11 is conducted. Specifically, as shown in FIG. 10, the wire 11 is fed by a length corresponding to a long side portion by the feed system 20. The first stopper block 55 is moved to a predetermined position. By the above steps, the wire 11 is edgewise bent at two portions. Subsequently, the first step to the eighth step are repeated without moving the upper guide 57. The wire 11 is therefore edgewise bent at four portions, namely, wound to form one turn of the winding 15.

Figure 11:
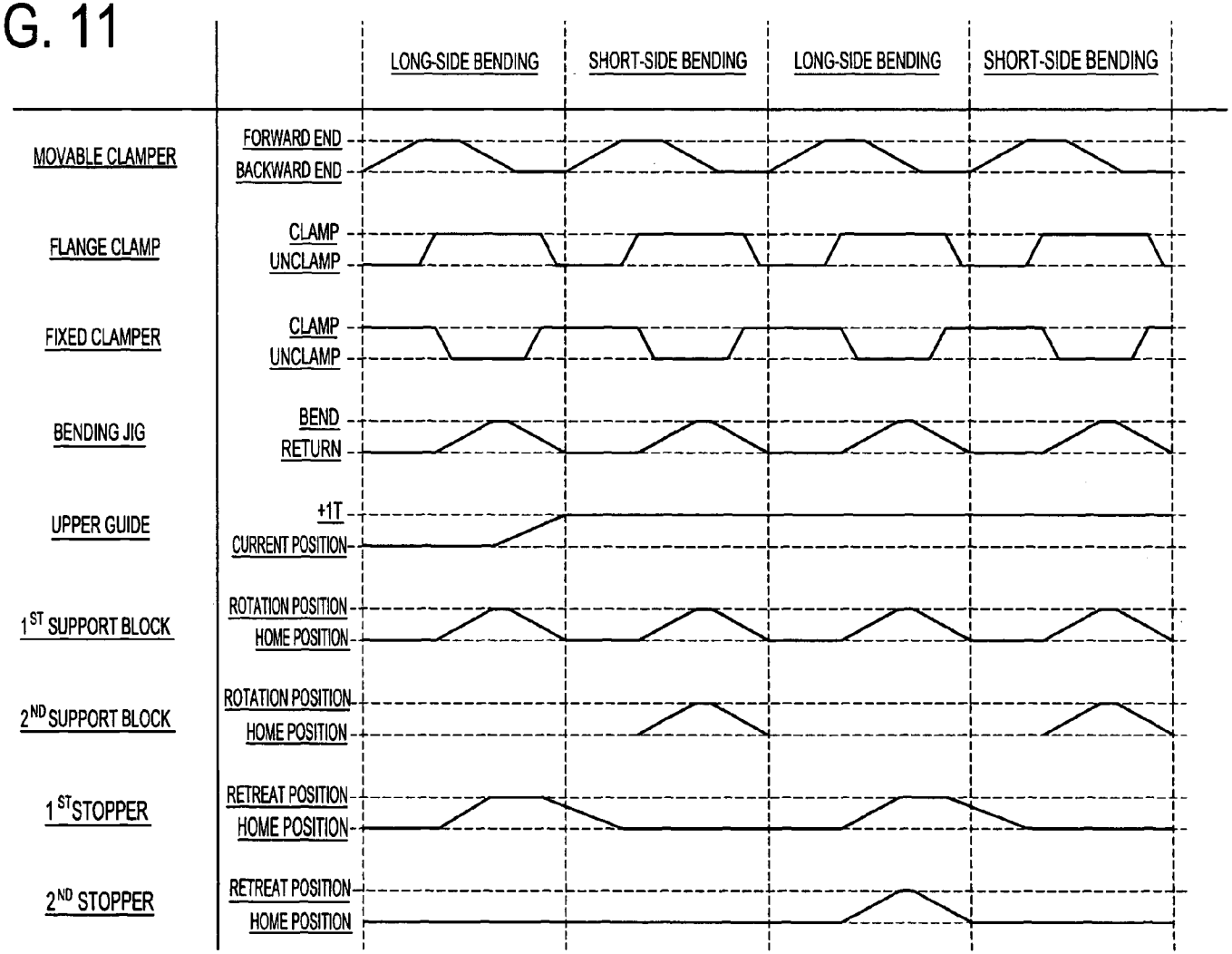
FIG. 11 is a graph showing cycles of mechanisms of the edgewise winding apparatus in the first embodiment.

FIG. 11 is a graph showing cycles of the systems and mechanisms of the edgewise winding apparatus 10, showing the cycles corresponding to one turn of the winding 15. For one turn, the edgewise bending needs to be performed four times. In other words, a series of the first to eighth steps is repeated twice to form one turn of the winding 15.

In the graph, a row titled "Movable Clamper" represents motion of the movable clamper 21, showing timings of a "Forward End" and a "Backward End". A row titled "Flange Clamper" represents motion of the flange clamp 51, showing timings of a "Clamp" state of holding the wire 11 and an "Unclamp" state of unclamping the wire 11 and moving to an upper end.

A row titled "Fixed Clamper" represents motion of the wire clamping part 30, showing timings of a "Clamp" state of holding the wire 11 and an "Unclamp" state of unclamping the wire 11 and moving to an upper end.

A row titled "Bending Jig" represents motion of the bending jig 54, showing timings of a "Bend" state in which the bending jig 54 is moved 90° to edgewise bend the wire 11 and a "Return" state in which the bending jig 54 is in a home position.

A row titled "Upper Guide" represents motion of the upper guide 57, in which "+1T" indicates upward movement at a distance corresponding to the thickness of the wire 11 and "Current Position" indicates a position of the upper guide 57 prior to the upward movement.

A row titled "$1^{st}$ Support Block" represents motion of the first support block 52. In this row, "Rotation Position" indicates a position of the block 52 at the end of the edgewise bending and "Home Position" indicates a standby position of the block 52.

A row titled "$2^{nd}$ Support Block" represents motion of the second support block 53. In this row, "Rotation Position" indicates a position of the block 53 at the end of the edgewise bending and "Home Position" indicates a standby position of the block 53.

A row titled "$1^{st}$ Stopper" represents motion of the first stopper block 55. In this row, "Home Position" indicates a position in which the block 55 supports the wire 15 and "Retreat Position" indicates a position in which the block 55 is retracted in order not to interfere with rotation of the winding 15.

A row titled "$2^{nd}$ Stopper" represents motion of the second stopper block 56. In this row, "Home Position" is a position in which the second stopper block 56 supports the winding 15 and guides the wire 11. "Retreat Position" is a position in which the second stopper block 56 is retracted in order not to interfere with rotation of the winding 15.

The motions of the movable clamper 21, flange clamp 51, wire clamp part 30, and bending jig 54 are operations in the first to eighth steps repeated twice mentioned referring to FIGS. 3 to 10. Thus, the details thereof are not repeated here.

The upper guide 57 is retracted upward from the start of a first long-side bending operation so as to move upward by a distance corresponding to the thickness of the wire 11 every time one turn of the winding 15 is wound. The first support block 52 is fixed to the rotary table 58 and hence moved in sync with rotation of the rotary table 58, namely, moved in the same manner as the bending jig 54.

On the other hand, the second support block 53 is fixed retractably to the rotary table 58 so that the block 53 is protruded from the upper surface of the rotary table 58 only at the time of short-side bending. In the graph, a section with no line represents the time for which the block 53 is stored or retracted in the rotary table 58.

The first stopper block 55 and the second stopper block 56 are moved to respective retract positions for a period in which they are likely to interfere with the winding 15 being rotated. If each of the first and second stopper blocks 55 and 56 can avoid interference with the winding 15 according to the shape or placement of the stopper blocks 55 and 56, they do not have to be moved to avoid the interference.

The first embodiment having the above configurations and operations provide the following advantages.

Firstly, the winding 15 can be wound at high speed. The edgewise winding method of the first embodiment for forming a non-circular edgewise winding including the bent portions 12*c*, the short side portions 12*a* and the long side portions 12*b* is achieved by feeding the wire 11 by a length corresponding to the short side portion 12*a* and the long side portion 12*b* and then edgewise bending the wire 11 by the bending jig 54 while rotating the entire winding 15, thereby forming the bent portion 12*c*. The side surface of the long side portion 12*b* of the winding 15 is supported by the side support member such as the first support block 52, the second support block 53, first stopper block 55, and the second stopper block 56.

As indicated above as the problem to be solved, if the wire 11 is wound at high speed to form the winding 15, the winding 15 in process of being formed may be deformed by inertia force. In the first embodiment, therefore, the side support member for supporting the side surface of the winding 15 is provided to solve such inertial problem.

Figure 12:
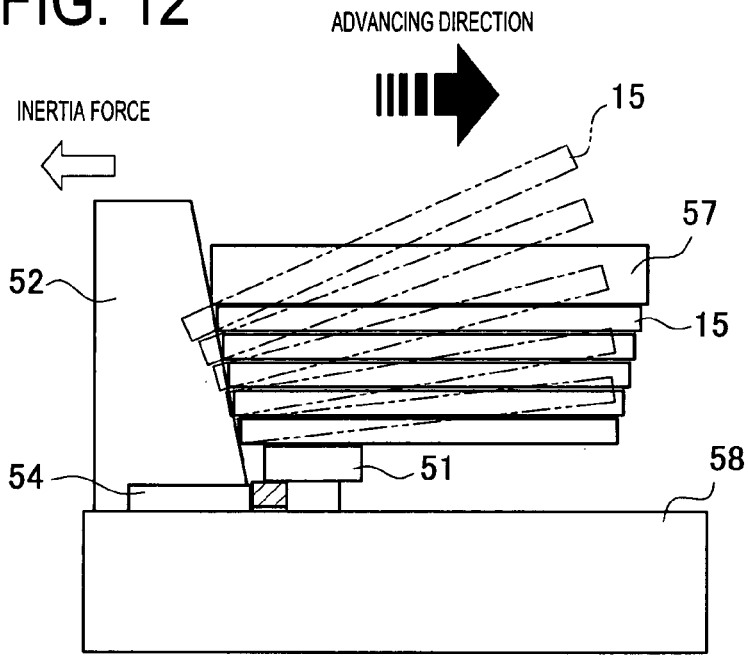
FIG. 12 is a side view showing a state where a side support member supports a rotation rear side of the winding.

FIG. 12 shows a state in which the rotation rear side of the winding 15 is supported by the side support member. At the time of edgewise bending of the wire 11 by the flange clamp 51 and the bending jig 54, when acceleration to the winding 15 increases, the inertia force acting on the winding 15 is larger than the stiffness of the wire 11. This causes plastic deformation of the winding 15. This phenomenon is essentially inevitable if the wire 11 is wound at a speed higher than a certain level.

However, in this embodiment, the rotation rear side of the winding 15, that is, the side surface of the winding 15 located on a rear side in the rotation direction of the rotary table 58 is supported by the first support block 52. This makes it possible to support the side surface of the winding 15 and prevent deformation of the winding 15 resulting from shape loss at the start of edgewise bending of the wire 11.

An inertia force occurs at the start and the end of the edgewise bending of the wire 11. Acceleration occurs when the winding 15 shifts from stop to rotation start and similarly when the winding 15 shifts from rotation to stop, thus generating the inertial force to the winding 15.

In the case where the winding 15 is not supported by the first support block 52, an inertia force acts on the winding 15 at the start of edgewise bending of the wire 11 and therefore a force to deform the winding 15 acts as shown by a double-dashed line in FIG. 12. This force is restrained by the first support block 52 and further the upper guide 57 is placed on the winding 15, so that the winding 15 can be edgewise bent while keeping its predetermined shape.

The second support block 53 can operate in the same manner as the first support block 52. However, the block 53 will exhibit substantially the same positional relation as the block 52 in FIG. 12. Thus, the details thereof are not repeated here.

Figure 13:
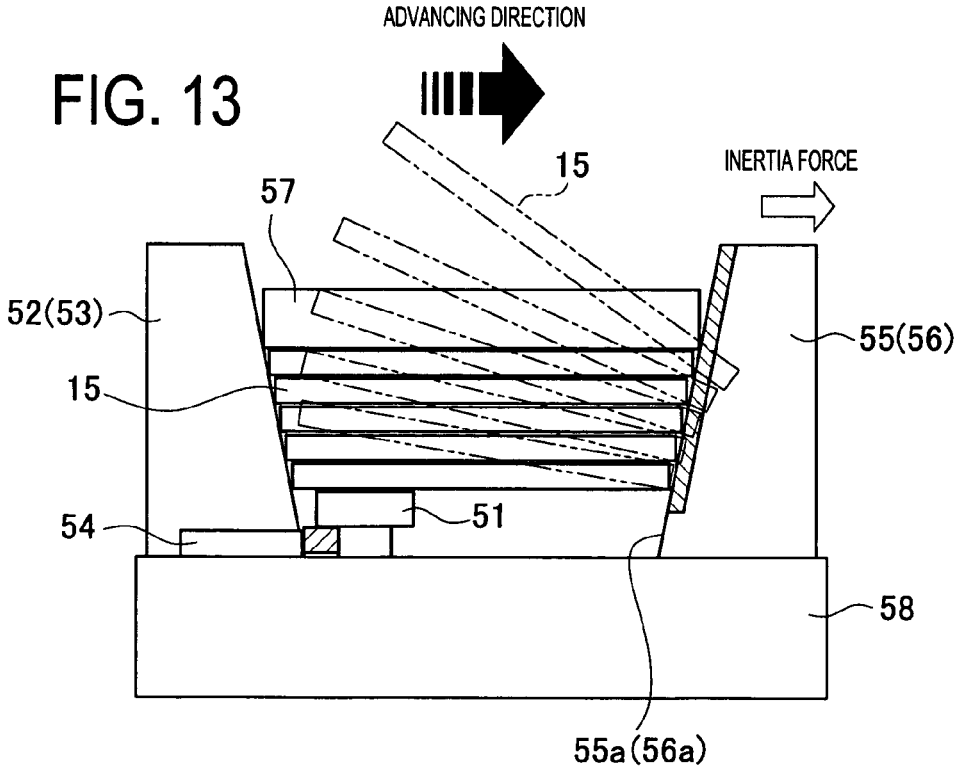
FIG. 13 is a side view showing a state where the side support member supports a rotation front side of the winding.

FIG. 13 shows a state in which a rotation front side of the winding 15 (i.e., a side surface of the winding 15 located on a front side in a rotation direction of the winding 15 to be turned) is supported by the side support member. Deformation (shape loss) of the winding 15 at the end of edgewise bending of the wire 11 is prevented by the first stopper block 55 placed on the rotation front side of the winding 15, that is, in front of the winding 15 in the rotation direction of the rotary table 58. In the winding 15, the inertia force also occurs at the end of edgewise bending of the wire 11 as with the start of edgewise bending. This inertia force will cause a force to deform the winding 15 as shown by a double-dashed line in FIG. 13. The influence of this inertia force is prevented by the first stopper block 55 and the upper guide 57. It is to be noted that the second stopper block 56 acts in a similar manner to the first stopper block 55 and thus the details thereof are not repeated here.

As above, the first support block 52 and the second support block 53 support the side surfaces of the winding 15, so that the winding 15 can be prevented from becoming deformed due to the inertial force at the start of edgewise bending. Furthermore, the first stopper block 55 and the second stopper block 56 support the side surfaces of the winding 15 to prevent deformation of the winding 15 due to inertia force at the end of edgewise bending. Thus, the high speed winding operation of the winding 15 can be performed.

<Second Embodiment>

Figure 14:
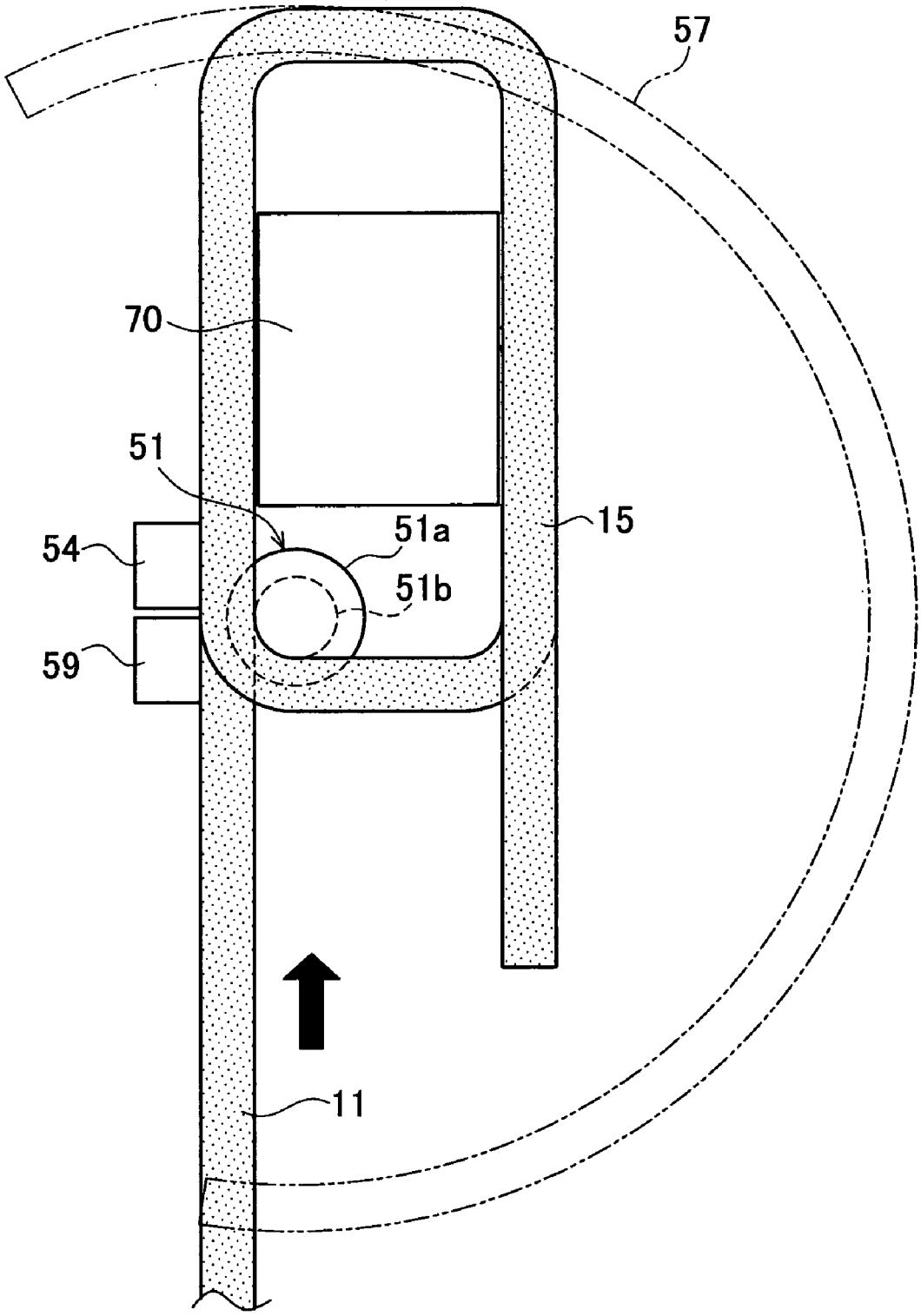
FIG. 14 is a configuration view of a bending system of an edgewise winding apparatus in a second embodiment.

FIG. 14 is a configuration view of a bending system 50 of an edgewise winding apparatus 10 in a second embodiment. This embodiment is almost the same in structure as the first embodiment excepting the bending system 50. The following explanation will therefore be focused on the bending system 50.

A center support block 70 is placed instead of the first support block 52, second support block 53, first stopper block 55, and second stopper block 56 and acts in the same manner as those blocks 52, 53, 55, and 56. The center support block 70 has a trapezoidal shape in cross section conforming to the inner periphery of the winding 15 so that the block 70 can be just fitted inside the winding 15, thereby serving as a common stopper for supporting both the rotation front and rear sides of the winding 15 from the inner periphery thereof to prevent a shape Loss thereof.

The center support block 70 is provided with a rotation system placed above the upper guide 57 and can be moved in sync with rotation of the rotary table 58 so as to trace the path along which the winding 15 will pass. The path of the winding 15 is the same as that shown in FIGS. 3 to 11 in the first embodiment and the details thereof are omitted.

The above center support block 70 has to be removed upward after the winding 15 is completed as the coil 12. Accordingly, the synchronization system for synchronously rotating the center support block 70 also has to be placed above the edgewise winding apparatus 10. The center support block 70 is further provided with a forward/backward moving mechanism of advancing and retracting the block 70 with respect to the winding 15. Since the apparatus 10 includes such center support block 70, even in the high-speed edgewise bending of the wire 11, the winding 15 can be prevented from becoming deformed due to the inertia force.

The present invention is not limited to the above embodiment(s) and may be embodied in other specific forms without departing from the essential characteristics thereof.

For instance, the position, the retract timing, and other conditions of the first stopper block 55 and the second stopper block 56 may be changed in relation to a change in the retract position.

For instance, the first stopper block 55 is retracted out of the rotation range of the winding 15. Alternatively, it may be retracted above the winding 15 instead of the position shown in FIG. 5 and others. The same applies to the second stopper block 56.

The invention claimed is:

1. An edgewise winding method for forming an edgewise winding having a non-circular outer shape including a bent portion and an unbent portion, wherein the outer shape is rectangular, and the unbent portion includes a pair of long side portions and a pair of short side portions, the method comprises:

repeatedly feeding a wire by a fixed distance corresponding to the long side portion;

repeatedly feeding the wire by a gradually changing distance corresponding to the short side portion; and edgewise bending the wire by a bending jig while rotating the entire winding to form the bent portion, a side surface of the unbent portion of the winding is supported by a first side support member for the short side portion and a second side support member for the long side portion;

after feeding the wire corresponding to the long side portion, rotating the first side support member in sync with the bending jig to bend the wire for long-side bending;

after feeding the wire corresponding to the short side portion, rotating the second side support member in sync with the bending jig to bend the wire for short-side bending.

2. The edgewise winding method according to claim 1, wherein a retaining member is slid in a direction of thickness of the winding, the retaining member having a shape along a rotation path of the unbent portion located on an outer circumferential side of the winding during rotation.

3. An edgewise winding apparatus for forming an edgewise winding having a non-circular outer shape including a bent portion and an unbent portion, the apparatus comprising:

a wire feed system for repeatedly feeding a wire by a predetermined distance; and a bending jig for repeatedly edgewise bending the wire while the entire winding is rotated, wherein the apparatus further comprises a first side support member for supporting the short side portion and a second side support member for supporting the long side portion of the winding, the outer shape is rectangular, the unbent portion includes a pair of long side portions and a pair of short side portions, and the wire feed system is configured to repeatedly feed the wire by a fixed distance corresponding to the long side portion and by a gradually changing distance corresponding to the short side portion;

the apparatus being configured so that:

after feeding the wire corresponding to the long side portion, the first side support member rotates in sync with the bending jig to bend the wire for long-side bending; and after feeding the wire corresponding to the short side portion, the second side support member rotates in sync with the bending jig to bend the wire for short-side bending.

4. The edgewise winding apparatus according to claim 3, further comprising a retaining member slidable in a direction of thickness of the winding, the retaining member having a shape along a rotation path of the unbent portion located on an outer circumferential side of the winding during rotation.

5. The edgewise winding method according to claim 1, wherein the side surface of the winding is in contact with a first stopper block at the end of the long-side bending, and the side surface of the winding is in contact with a second stopper block at the end of the short-side bending.

6. The edgewise winding method according to claim 5, wherein the second stopper block is in a retracted position at the end of the long-side bending, and the first stopper block is in a retracted position at the end of the short-side bending.

7. The edgewise winding apparatus according to claim 3, wherein the side surface of the winding is in contact with a first stopper block at the end of the long-side bending, and the side surface of the winding is in contact with a second stopper block at the end of the short-side bending.

8. The edgewise winding apparatus according to claim 7, wherein the second stopper block is in a retracted position at the end of the long-side bending, and the first stopper block is in a retracted position at the end of the short-side bending.

* * * * *